United States Patent [19]

Morishita et al.

[11] Patent Number: 5,012,686

[45] Date of Patent: May 7, 1991

[54] PINION SHIFTING MECHANISM OF AN ENGINE STARTER

[75] Inventors: Akira Morishita; Shuzoo Isozumi; Toshinori Tanaka, all of Himeji, Japan

[73] Assignee: Mitsubishi Denki Kabushiki Kaisha, Tokyo, Japan

[21] Appl. No.: 389,725

[22] Filed: Aug. 4, 1989

[30] Foreign Application Priority Data

| | | | |
|---|---|---|---|
| Aug. 6, 1988 | [JP] | Japan | 63-196901 |
| Aug. 24, 1988 | [JP] | Japan | 63-210211 |
| Mar. 8, 1989 | [JP] | Japan | 1-56653 |

[51] Int. Cl.[5] ..... F02N 11/00

[52] U.S. Cl. ..... 74/7 A; 74/6; 74/7 R; 123/179 M; 290/48

[58] Field of Search ..... 74/6, 7 R, 7 A, 7 C, 74/7 B; 123/179 M; 290/38 R, 38 C, 48

[56] References Cited

U.S. PATENT DOCUMENTS

| | | | |
|---|---|---|---|
| 2,354,844 | 8/1944 | Thornburg | 74/7 E |
| 2,947,179 | 8/1960 | Lafitte | 74/6 |
| 2,960,879 | 11/1960 | Lafitte | 74/6 |
| 3,304,790 | 2/1967 | Takami | 74/6 |
| 4,154,117 | 5/1979 | Mazzorana | 74/7 A |
| 4,175,237 | 11/1979 | Mazzorana | 74/7 A |
| 4,262,546 | 4/1981 | Mazzorana | 74/7 A |
| 4,356,735 | 11/1982 | Bögner et al. | 74/7 A |
| 4,520,285 | 5/1985 | Isozumi et al. | 310/83 |

FOREIGN PATENT DOCUMENTS

| | | | |
|---|---|---|---|
| 2033054 | 1/1972 | Fed. Rep. of Germany | 123/179 M |
| 58-101265 | 6/1983 | Japan | 290/38 R |
| 837530 | 6/1960 | United Kingdom | 74/7 A |

*Primary Examiner*—Leslie A. Braun
*Assistant Examiner*—Scott Anchell
*Attorney, Agent, or Firm*—Sughrue, Mion, Zinn, Macpeak and Seas

[57] ABSTRACT

A pinion shifting mechanism of an automotive engine starter is disclosed in which the pivot support 5c of the shift lever 5 on which it turns is supported at its rear side by a resilient support means 32 instead of a rigid support surface. The shift lever operatively coupling the plunger 7 of the electromagnetic switch 4 with the pinion assembly is coupled to the plunger via an engager member 15 slidably disposed in the cylindrical bore formed in the plunger. The engager member is urged backward with respect to the plunger by a helical spring 17 disposed around the engager within the bore of the plunger. When the plunger is attracted from the initial front position toward the stationary core 8 of the electromagnetic switch, the resilient support means yields first to allow a backward translation of the pivot support of the shift lever; the spring urging the engager yields only afterwards. In another aspect, the rear as well as the front side of the pivot support of the shift lever is supported by a rigid support surface; however, the two support surfaces are disposed in such a manner that a gap 51 is formed between the rear side of the pivot support of the shift lever and the forward directed support surface 23 when the plunger is at the front position.

7 Claims, 8 Drawing Sheets

PINION SHIFTING MECHANISM OF AN ENGINE STARTER

BACKGROUND OF THE INVENTION

This invention relates to engine starters, and more particularly to pinion shifting mechanisms of an automotive engine starter for translating the pinion into meshing engagement with the ring gear of the engine.

Generally, automotive internal combustion engines comprise engine starters driven by an electric motor. FIG. 1 shows a typical structure of an automotive engine starter 1 which comprises four main portions: a dc electric motor 2; a pinion assembly 3 mounted slidably on the output shaft 2*b* of the motor 2; an electromagnetic switch device 4 disposed at a side of the electric motor 2; and a shift lever 5 operatively coupling the plunger or armature of the electromagnetic switch device 4 with the pinion assembly 3. Let us describe these portions in the above order.

The armature shaft 2*a* of the electric motor 2 has an extension (i.e. the output shaft) 2*b* extending forward (toward right in the figure) from the motor 2. The pinion assembly 3 slidably mounted on the output shaft 2*b* of the motor 2 comprises a unidirectional or one-way clutch 18 consisting of a clutch outer member 18*a*, an inner member 18*b*, and rollers 18*c* disposed between the outer and inner members 18*a* and 18*b*, wherein the pinion 19 for engaging with the ring gear of the engine (not shown) forms a forward extension of the clutch inner member 18*b*. The rear cylindrical extension 20 of the clutch outer member 18*b* is splined at its inner surface to the outer surface of the output shaft 2*b* on which helical splines 2*c* are formed. Thus, the pinion assembly 3 is slidable on the output shaft 2*b* in the axial direction, transmitting the torque of motor 2 unidirectionally via the one-way clutch 18. Further, on the outer surface of the rear cylindrical extension 20 is secured a stop disk 21 so that the bifurcate lower end potion 5*b* of the shift lever 5 extends between the stop disk 21 and the rear surface of the clutch outer member 18*a* to engage with the pinion assembly 3 thereat.

The electromagnetic switch device 4, for driving and shifting the pinion assembly 3 and for making the energization current of the motor 2, comprises a stationary core and frame assembly and an armature or plunger assembly disposed slidably therein. First, let us describe the stationary portion:

The cylindrical outer frame 6 comprises an annular front end wall 6*a* through which the plunger 7 extends. An annular disk-shaped stationary core 8, having an inner cylindrical extension opposing the annular rear end surface of the plunger 7 across a gap g, is secured to the rear end of the frame 6 to form together therewith a frame assembly within which an excitation coil 10 wound on a coil bobbin 9 is accomodated. Further, the rear end of the frame assembly is covered by a cap 13 of synthetic resin, through which extends a terminal bolt 14 having a stationary contact point 14*a* at the front end thereof.

On the other hand, the plunger assembly comprises the cylindrical plunger 7 which, when the coil 10 is energized, is attracted toward the core 8 to slide within the inner surface of the coil bobbin 9. The plunger 7 has a rod-shaped rear extension (plunger rod) 7*a* extending through the central aperture of the core 8; on the plunger rod is mounted an annular disk-shaped movable contact 12 via a support sleeve 12*a*. The sleeve 12*a* is slidable on the rod 7*a*, and is urged by a helical spring 24 toward the stop ring 7*c* secured on the rod 7*a*; thus, the movable contact 12 yields and slides on the rod 7*a* by a predetermined small axial length when the plunger 7 is translated to its extreme rear position and the contact 12 comes into contact with the stationary contact 14*a*. Further, the plunger 7 has a central cylindrical bore 7*b* formed therein to open toward forward direction; within this bore 7*b* extends axially slidably a piston-like lever engager member 15 having a flange 15*a* at the rear end thereof. The front extension of the engager member 15 extends forward from the front end of the bore 7*b* through an annular member 16 closing the bore 7*b*, and a pair of engagement disks 15*b* secured to the front extension of the member 15 engage with the bifurcate upper end of the lever 5. Further, a helical urging spring 17, disposed around the engager member 15 within the bore 7*b* of the plunger 7 to bear on the annular member 16 secured to the plunger 7 at one end and on the flange member 15*a* of the engager 15 at the other, urges the member 15 deeper into the bore 7*b*. Further, a helical return spring 11 is disposed between the plunger 7 and the core 8 to bear on the rear end of the plunger 7 and the inner radial extension of the core 8; the return spring 11 urges the plunger 7 in the direction away from the core 8.

The lever 5 having upper and lower engaging end portions 5*a* and 5*b* is pivoted on the pivot support 5*c* situated substantially at the middle of the length of the lever 5. The pivot support 5*c* is held between a support surface 22*a* of the front bracket 22 of the starter 1 and a metal plate 23 secured on a support base 23*a*. Thus, the lever 5 is rotatable on the pivot support 5*c*.

Let us now describe briefly the operation of the starter 1. When the key switch (not shown) of the automobile is turned on, an excitation current is supplied to the coil 10 of the electromagnetic device 4; thus, the resulting magnetic force attracts the plunger 7 toward the core 8. The movement of the plunger 7 is transmitted, via the engager member 15 and the lever 5, to the pinion assembly 3; thus, the lever 5 rotates, in the counter-clockwise direction in the figure, until the side of the pinion 19 abuts against the sides of the teeth of the ring gear of the automotive engine (not shown) to stop the rotation of the lever 5. When the rotation of the lever 5 is stopped, the movement of the engager member 15 engaging with the lever 5 is also stopped. The plunger 7, however, continues to translate further toward the core 8, thereby compressing the spring 17; thus, the compressed spring 17 urges, via the engager member 15 and the lever 17, the pinion 19 against the ring gear of the engine. Finally, the movable contact 12 comes into contact with the stationary contact 14*a* to make the energization current supplied to the electric motor 2. The ensuing torque of the output shaft 2*b* of the motor 2 is transmitted via the one-way clutch 18 to the pinion 19. Thus, the pinion 19 rotates to a teeth-to-gap position (i.e. meshing angle) with respect to the ring gear of the engine; as a result, the pinion 19, thanks to the urging force of the compressed spring 17 transmitted via the lever 5, is translated axially forward into a fully meshing engagement with the ring gear of the engine.

Thus, the elecromagnetic switch device 4 has twofold functions: first, it functions as a relay for making the energization current supplied to the motor 2; second, it drives and shifts, via the rotation of the lever 5, the pinion assembly 3 into engagement with the ring gear of the engine.

The pinion shifting mechanism of the above described starter, however, suffers from the disadvantage that it is large-sized and expensive. This is deemed in the main due to the following factors:

(1) In order to ensure that the pinion 19 is forced into secure engagement with the ring gear of the engine, the urging spring 17 must be capable, when compressed, of exerting a force strong enough to compel the pinion 19 into engagement with the ring gear. The urging force of the compressed spring 17, however, also acts against the movement of the plunger 7 toward the core 8 when the rotation of the lever 5 is stopped. In order to overcome the strong force of the urging spring 17 against the movement of the plunger 7, the coil 10 must be capable of developing a magnetic force strong enough to attract the plunger 7 toward the core 8 against the urging force of the spring 17. Thus, a large-sized coil 10 with a large amount of expensive copper is necessary.

(2) For the purpose of ensuring a reliable operation of the starter device, a considerable amount of clearance is needed with respect to the engangements of the lever 5 with the engager member 15 on the one hand and with the one-way clutch 18 on the other; namely, a certain amount of clearance must be provided between the upper end 5*a* of the lever 5 and opposing surfaces of the engagement disks 15*b* secured to the engager member 15; the same is true with respect to the clearance between the lower end 5*b* of the lever 5 and the opposing surfaces of the stop disk 21 and the clutch outer member 18*a*. (The reason therefor is made clear below in the description of the preferred embodiments.) In order to compensate for this large clearance provided for the engagement of the lever 5 at the upper and lower ends thereof, the total length of the gap g between the plunger 7 and the core 8 travelled by the plunger 7 from its initial front to final rear position must be made longer. This results in further increase in the size of the device.

(3) The length of the upper arm of the lever 5 from the pivot support 5*c* to the upper end 5*a* thereof also necessitates that the plunger 7 moves over a large gap length g. This is an additional factor for increasing the size of the starter device.

Of the above three factors which contribute to the increase in the size and cost of the starter, let us now explain the first mentioned one in some detail by reference to FIG. 2. FIG. 2 shows, in a solid curve P and a dots and dash curve P', the relation between the gap length g (taken along the abscissa) between the plunger 7 and the core 8 and the magnetic attractive force (taken along the ordinate) acting therebeteen; further, the urging force of the compressed spring 17 acting on the plunger 7 when the plunger 7 is at a distance g from the core 8 is shown by the solid curve S. The urging force S begins to act on the plunger 7, in the direction away from the core 8, when the side of the pinion 19 abuts on the side of the ring gear of the engine; thereafter, the urging force S increases linearly with the decrease of the gap length g. On the other hand, the magnetic attracting force P or P' acting on the plugner 7 toward the core 8 is roughly inversely proportional to the gap length g, the magnitude of the force P or P' at respective gap lengths g being determined by the voltage supplied to the excitation coil 10. Generally, the starter device 1 is supplied with an electric power from a storage battery at the rated voltage of 12 V; the solid curve P shows the attractive force acting on the plunger 7 at the rated voltage of 12 V. However, due to various factors such as the temperature rise, the voltage applied across the coil 10 may occasionally be reduced to or below about two thirds ($\frac{2}{3}$) of the rated value, i.e. to or below about 8 V; in such case, the attracting force acting on the plunger 7 may be reduced to the level shown by the dots and dash curve P', which touches on the curve S of the urging force of the spring 17. If this happens, the attracting force P' acting on the plunger 7 toward the core 8 and the urging force S acting thereon in the direction away from the core 8 is balanced at the gap length g at which the two curves P' and S are tangent to each other; hence, the plunger 7 cannot be moved toward the core 8 beyond that gap length at which the two forces are balanced, with the result that the energization current can never be supplied to the motor 2. Howver, the magnitude of the urgining force S (at respective gap lengths g) of the spring 17 cannot be reduced below a predetermined level, since it must be strong enough to force the pinion 19 into eangagement with the ring gear of the engine; thus, the number of turns of the coil 10 should be selected large enough to ensure that the resulting attracting force P' is substantially above the level of the urging force S over the whole gap length g even when the voltage supplied thereto is reduced to substantially below the rated voltage.

With regard to the second and third factors (2) and (3) mentioned above, we may note the following points which are related to the first factor (1). As shown in FIG. 2, the attractive force P or P' acting on the plunger 7 from the core 8 is roughly inversely proportional to the gap length g. Thus, if the initial gap length g (i.e. the whole distance travelled by the plunger 7) is reduced, the coil 10 of the same size develops a greater attractive force P or P' over the length of axial movement of the plunger 7 from its initial (extreme front) to the final (extreme rear) position. If, on the contrary, the initial gap length is great, the magnitude of the attracting force P or P' is reduced to a very low level near the initial position of the plunger 7; this results in the need for a large-sized excitation coil 10. Thus, the greater initial gap length not only results in larger axial dimension of the electromagnetic switch device 4, but also in a larger and more expensive coil 10 thereof.

SUMMARY OF THE INVENTION

It is a primay object of this invention therefore to provide a starter device which is small-sized and less expensive. More particularly, the object of this invention is to provide a small-sized and less expensive pinion shifting mechanism of a starter, in which a small-sized electromagnetic switch is capable of translating the pinion against an urging force of the spring which forces the pinion into secure engagement with the driven gear.

The above objects are accomplished in accordance with a first aspect of this invention in an engine starter in which the pivot support of the shift lever operatively coupling the plunger of the electromagnetic switch with the pinion assembly is supported at its rear side by a resilient support means, instead of by a rigid support surface. The resilient support means comprises an urging spring which urges the pivot support of the shift lever forward toward the opposing rigid support surface, while allowing, by the yielding of the urging spring thereof, the backward movement of the pivot support of the shift lever away from the rigid support surface over a predetermined length. Otherwise, the starter is similar to that described above, except for the reduction of its size. (Thus, it comprises, in addition to an electric motor and a pinion assembly mounted slidably on the output shaft thereof, an electromagnetic switch including a plunger, and a shift lever operatively coupling the plunger with the pinion assembly, the shift lever being coupled at its one end to the plunger via an engager member which is urged, with respect to the plunger, backward by an urging spring.)

It is preferred that the spring characteristic of the urging spring of the resilient support means is selected, with respect to that of the urging spring urging the engager member with respect to the plunger, such that the following condition is satisfied: when the plunger of the electromagnetic switch is driven from the front to the rear position to shift the pinion assembly forward, the urging spring of the resilient support means yields first before the yielding of the urging spring urging the engager member takes place.

Thus, according to the first aspect of this invention, the initial weaker attractive force of the electromagnetic switch acting on the plunger is opposed only by the urging force of the resilient support means; on the other hand, when the plunger is translated to its extreme rear position to shift the pinion assembly forward into engagement with the driven gear of the engine, the urging spring urging the engager member acts first to force the pinion into engagement via the turning of the shift lever. Thus, in spite of the strong force of the spring which urges the engager member to force the pinion into engagement at the first stage, a small-sized electromagnetic switch suffices to move the plunger reliably from the front to the rear position.

It is further preferred that the dimensional relationship of the pinion shift mechanism of the starter is selected in this manner: after the plunger is driven from the front to the rear position and the pinion is shifted, via the shift lever, into full engagement with the driven gear of the engine, first by the urging force of the spring urging the engager member and then by an additional length by the urging force of the spring of the resilient support means, even then, a gap of predetermined length corresponding to the axial yielding length of the movable contact mounted on an extension rod of the plunger is formed between the front side of the pivot support of the shift lever and the opposing support surface. Thanks to the provision of this gap, the clearance at the engagements of the shift lever can be reduced to a negligible minimum.

According to another aspect of this invention, instead of the resilient support means provided according to the first aspect of this invention, the backward movement of the pivot support of the shift lever is limited by a forward directed rigid support surface in such a manner that a gap is formed between the forward directed rigid support surface and the rear side of the pivot support of the shift lever when the plunger is at the front postion. The effect of this gap on the pinion shifting operaton is substantially similar to that of the resilient support means according to the first aspect.

According to still another aspect, the central axis of the engager is displaced with respect to that of the plunger toward the output shaft of the motor. This feature, which can be used in combination with those of the first or second aspect of this invention, is effective in reducing the length of the arm of the shift lever from its pivot to the end engaged with the plunger via the engager member, and hence in reducing the initial gap length between the plunger and the stationary core of the electromagnetic switch.

The novel features which are believed to be characteristic of this invention are set forth with particularity in the appended claims. This invention itself, however, both as to its structure and method of operation, together with further objects and advantages thereof, may best be understood from the following detailed description of the preferred embodiments taken in conjunction with the accompanying drawings.

BRIEF DESCRIPTION OF THE DRAWINGS

In the drawings, like reference numerals respresent like or corresponding parts.

DETAILED DESCRIPTION OF THE PREFERRED EMBODIMENTS

In the following the preferred embodiments of this invention are described by reference to the drawings.

Figure 1:
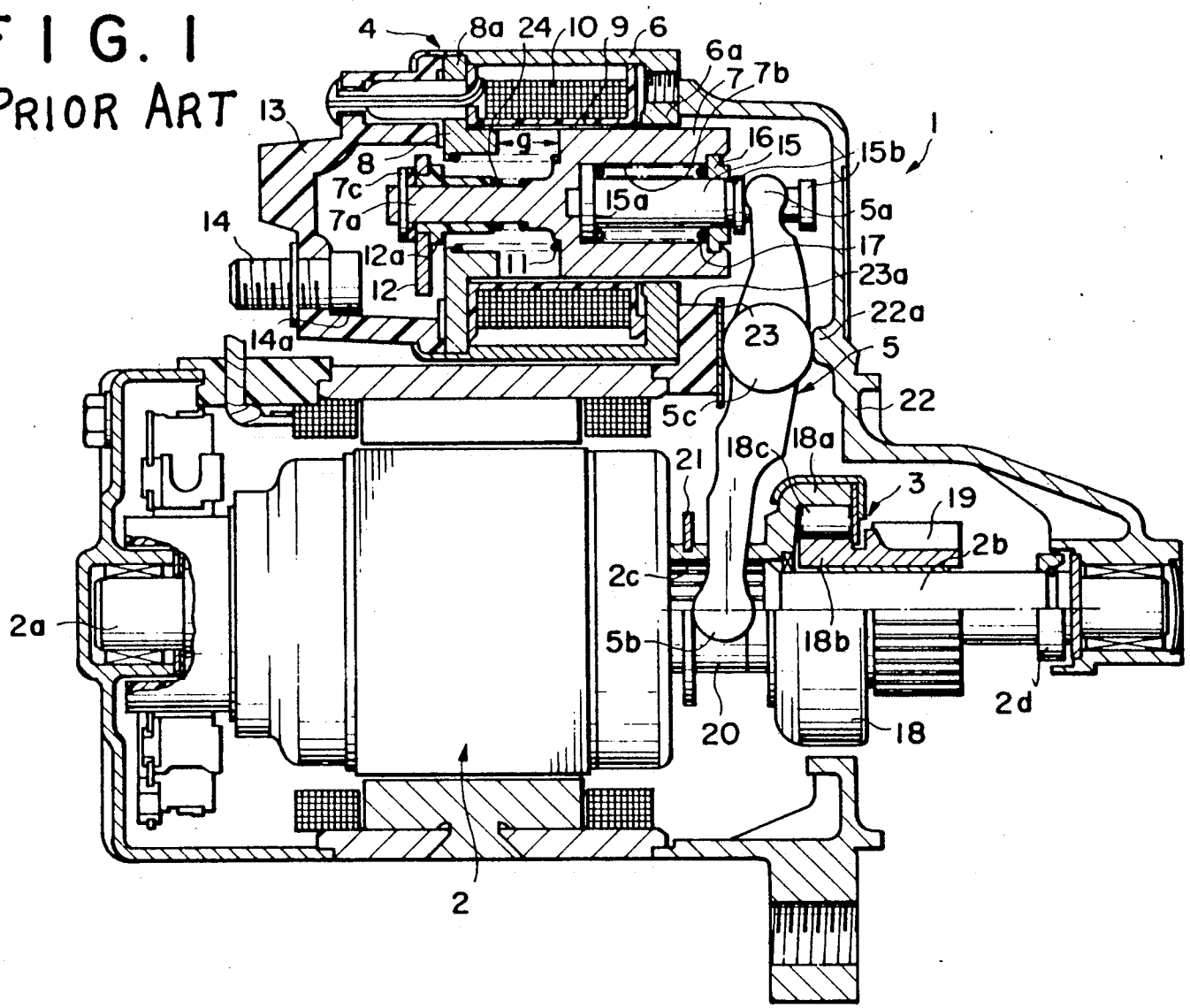
FIG. 1 PRIOR ART
FIG. 1 is a sectional view along the axis of a conventional automotive engine starter, showing the details of the pinion shifting mechanism thereof.
Figure 2:
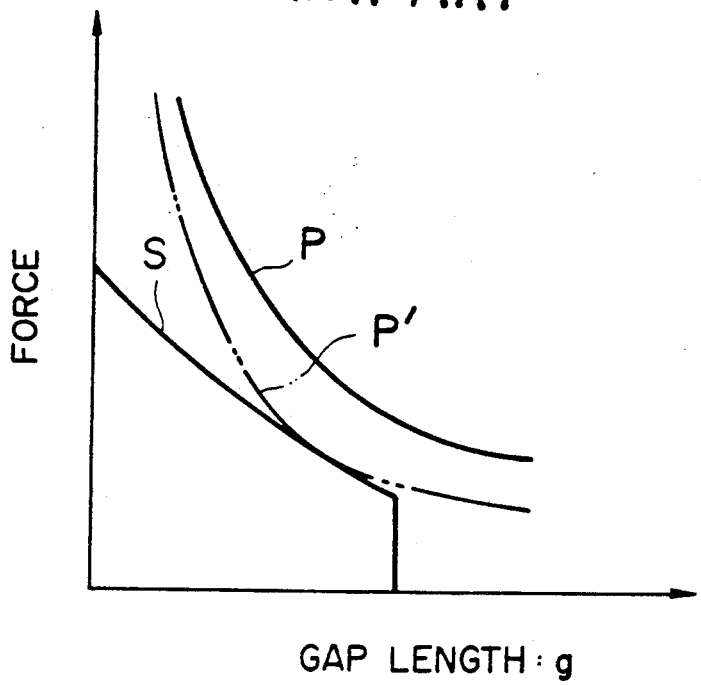
FIG. 2 PRIOR ART
FIG. 2 is a diagram showing the relationship of the forces developed in the pinion shifting mechanism within the starter of FIG. 1.
Figure 3:
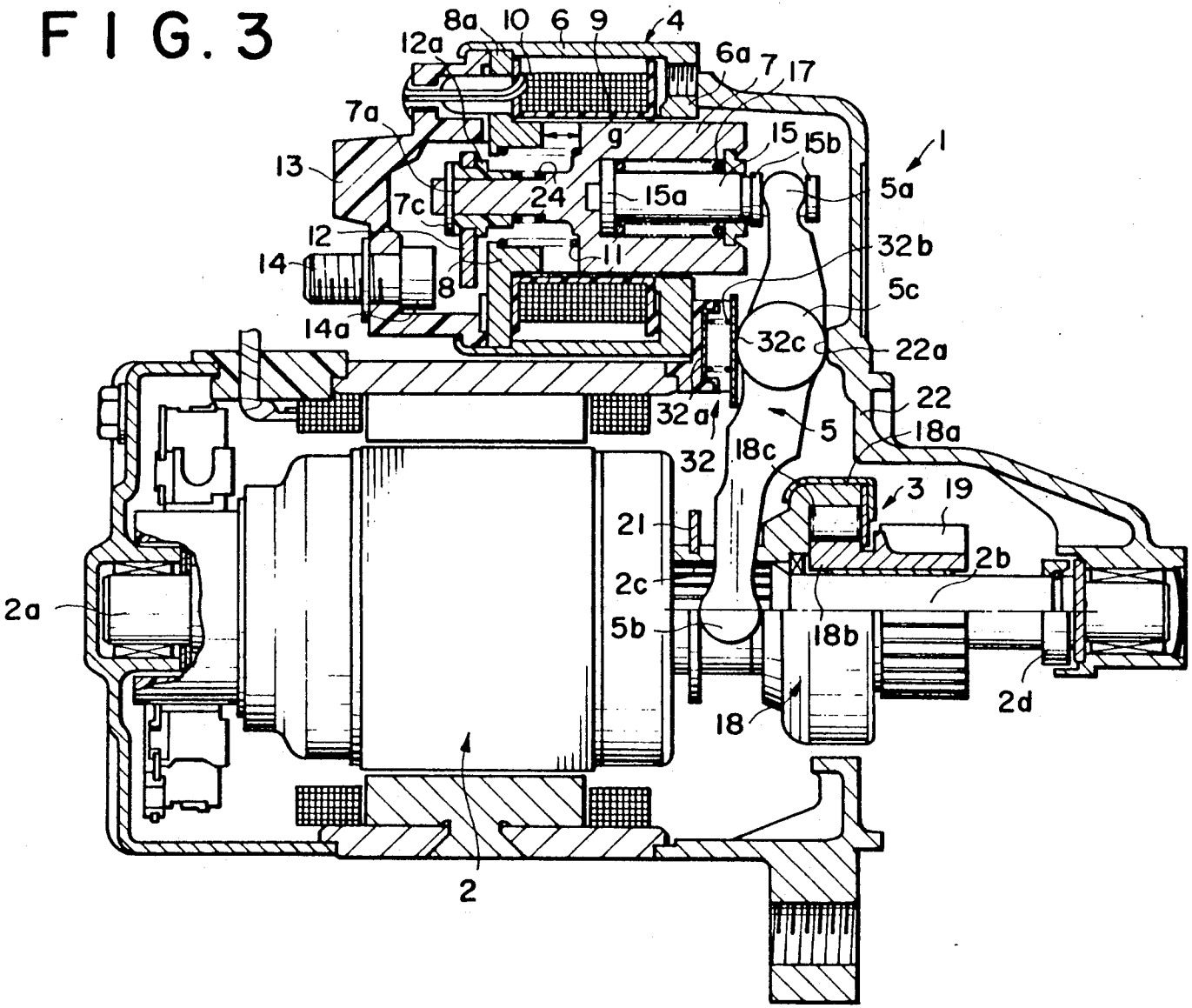
FIG. 3 is a view similar to that of FIG. 1, but showing an automotivie engine starter according to a first embodiment of this invention which includes a resilient support means.

FIG. 3 shows an engine starter according to a first embodiment of this invention. The starter device 1 of FIG. 3 is substantially similar to that of FIG. 1 described above; thus, it comprises four main portions: a dc electric motor 2 for starting the associated engine; a pinion assembly 3 slidably mounted on the output shaft 2*b* of the motor 2; an electromagnetic switch device 4 for making the energization current supplied to the motor 2 and for shifting the pinion assembly 3; and a lever 5 for operatively coupling the plunger 7 of the switch device 4 with the pinion assembly 3. The parts which correspond to and are similar to the parts of the starter of FIG. 1 are designated by the same reference numerals, whereby the description of such parts are not repeated here. The difference, on the other hand, lies in the following points:

(a) In the case of the starter of FIG. 1, the rear side of the pivot support 5*c* of the lever 5 is supported substantially rigidly by the metal plate 23 mounted on the support base 23*a*; in the case of the starter of FIG. 3, however, it is supported by a resilient support means 32. This is the obvious and most important structural difference.

(b) The clearance at the upper and lower engaging ends of the lever 5 is negligibly small in the starter of FIG. 3; it is only enough to allow the operation of the lever 5. In contrast thereto, the clearance in the starter of FIG. 1 is large enough to compensate for the axial yielding length of the movable contact 12 on the plunger rod 7*a* upon contact with the stationary contact 14*a*. The reduction of the clearance in the starter of FIG. 3 is made possible by the provision of the resilient support means 32 mentioned in (a) above, as will be made clear below.

(c) The maximum (i.e. inital) gap length g between the plunger 7 and the stationary core 8 is smaller in the starter of FIG. 3; this results from the difference (b) above.

(d) The excitation coil 10 is smaller in the starter of FIG. 3; this is made possible by the differences (a) and (c) above, as will become clear from in the following.

Further, as a result of (b) through (d), the overall size and cost of the starter of FIG. 3 is reduced compared with that of the starter of FIG. 1. Furthermore, thanks to the structural difference (a), the starter of FIG. 3 is provided with an urging spring 17 having a greater spring modulus, as explained below.

Of the above differences (a) through (d), let us first describe, in connection with (a), the structure of the resilient support means 32. The resilient support means 32 comprises: a spring support base 32*a* secured to the front end wall 6*a* of the outer frame 6 of the switch 4 and to the yoke of the motor 2, and having a recess formed on the outer (i.e., front end) end surface thereof; a helical spring 32*b* bearing at its one end on the bottom surface of the recess of the support base 32*a* to extend forward in the axial direction of the starter device 1; and a metal disk plate 32*c* attached to the other end of the spring 32*b* to bear on the rear side surface of the pivot support 5*c* of the lever 5. Thus, the spring 32*b* urges, when compressed, the pivot support 5*c* of the lever 5 toward right in the figure. The movement of the plate 32*c* in the backward direction (toward left in the figure) is limited by the periphery of the support base 32*a* which abuts thereon. (It is possible, however, to adopt such a structure wherein the backward movement of the plate 32*c* is limited by the total compressive yielding length of the spring 32*b*, instead of by the periphery of the support base 32*a*.)

Referring to FIGS. 4*a* through 4*d* and 5, let us now describe the operation of the pinion shifting mechanism within the starter of FIG. 3, especially in reference to that of the resilient support means 32.

Figure 4A:
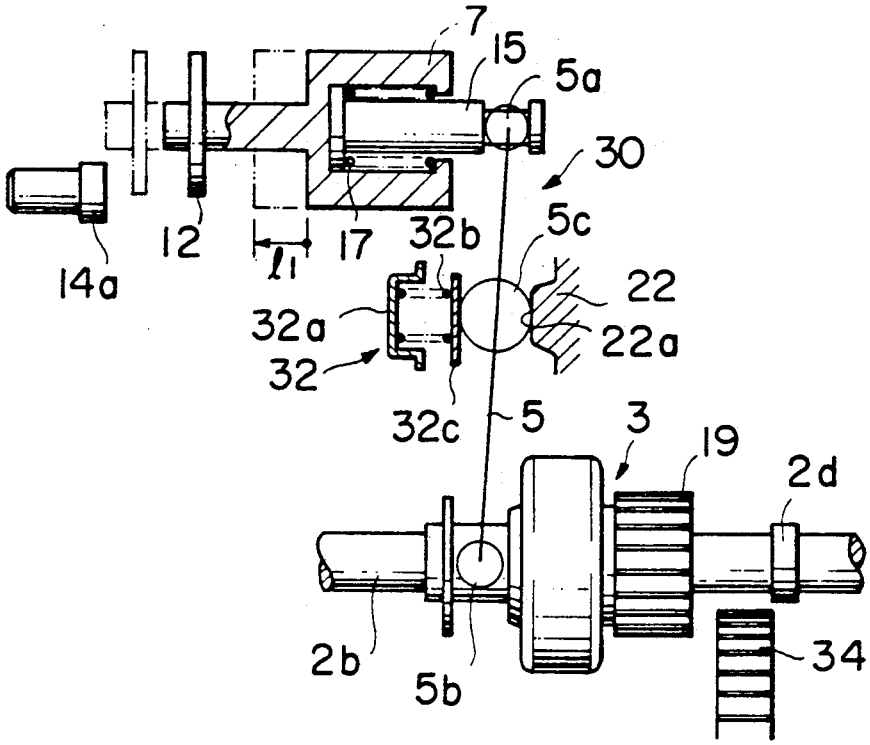
FIGS. 4 through 4*d* are schematic diagramatic views showing the operation of the pinion shifting mechanism of the starter of FIG. 3.

Before the electric power is supplied to the starter device 1, the plunger 7 is at the initial or extreme front position, being urged by the return spring 11. At this stage, the relative position of the plunger 7, the lever 5 and the pinion assembly 3 is as shown in FIG. 4*a*: the spring 32*b* of the resilient support 32 urges the plate 32*c* against the pivot support 5*c* of the lever 5, so that the front side of the pivot support 5*c* of the lever 5 abuts on the opposing support surface 22*a* of the bracket 22.

When the key switch of the automobile is turned on, electric power is supplied from the storage battery (not shown) to the excitation coil 10 of the electromagnetic switch device 4; the resulting magnetic force generated by the coil 10 attracts the plunger 7 toward the stationary core 8. As a result, the lever 5 rotates on the support 5*c* to shift the pinion assembly 3 forward to a position at which the side of the pinion 19 abuts against the side of the ring gear 34 of the engine, thereby limiting the further forward sliding movement of the pinion assembly 3 on the output shaft 2*b* of the motor 2. The plunger 7, however, continues to move toward the core 8 (toward left in the figure). Thus, the spring 32*b* of the resilient support 32 yields and is compressed until the plate 32*c* abuts on the periphery of the support base 32*a*, to reach the stage shown in FIG. 4*b*. During the time in which the spring 32*b* is compressed, the plunger moves for an axial length $l_1$ corresponding to the compression of the spring 32*b*; the urging spring 17 does not yield and is not compressed during this period from the stage represented in FIG. 4*a* to the stage represented in FIG. 4*b*.

Figure 5:
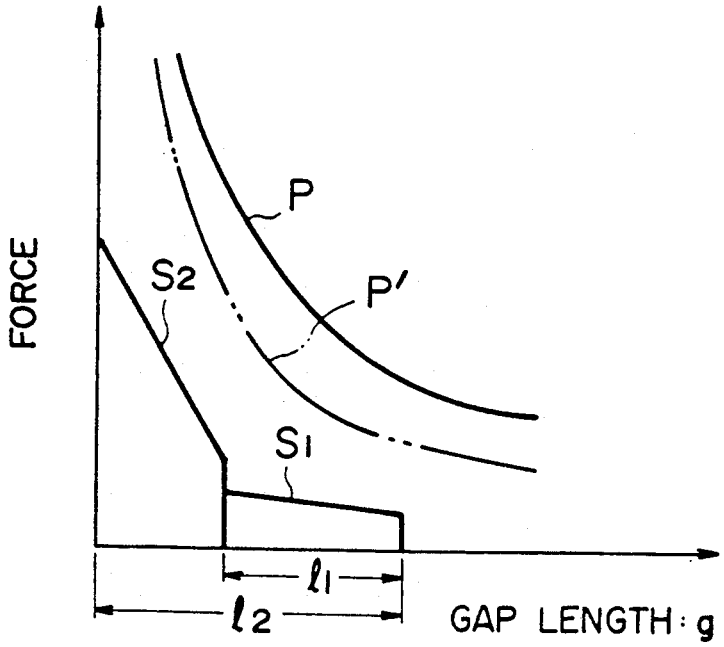
FIG. 5 is a diagram similar to that of FIG. 2, but showing the relationship of the forces developed in the pinion shifting mechanism within the starter of FIG. 3.

As shown in FIG. 5, the urging force S1 of the spring 32*b* of the resilient support means 32 acting on the lever 5 increases linearly with the decrease of the gap length g over the inital length $l_1$. The urging force S1 of the spring 32*b* (more precisely, the force S1, as represented in FIG. 5, is equal to the value (y/x) S1', wherein S1' is the urging force of the spring 32*b* acting on the pivot support 5*c* of the lever 5, x is the total length of the lever 5 from the lower end 5*b* to the upper end 5*a* and y is the partial length thereof from the lower end 5*b* to the pivot support 5*c*) is much smaller than the level of the attracting magnetic forces P (developed by the coil 10 at the rated or normal voltage) or even P' (developed when the voltage is reduced, for example, to about two thirds of the rated voltage) acting on the plunger 7 toward the core 8. It is noted that the greatest value of the urging force S1 of the spring 32*b*, which is attained at the left end of the length $l_1$ in FIG. 5, is smaller than the smallest or minimum value of the urging force S2 of the spring 17 acting on the lever 5 via the engager member 15 (as shown in FIG. 5, this minimum value of the urging force S2 is developed by the spring 17 when the spring 17 just begins to act on the engager member 15); this is the reason that the spring 32*b* first yields over the initial length $l_1$ of the movement of the plunger 7 while the spring 17 remains uncompressed over the same length.

Figure 4B:
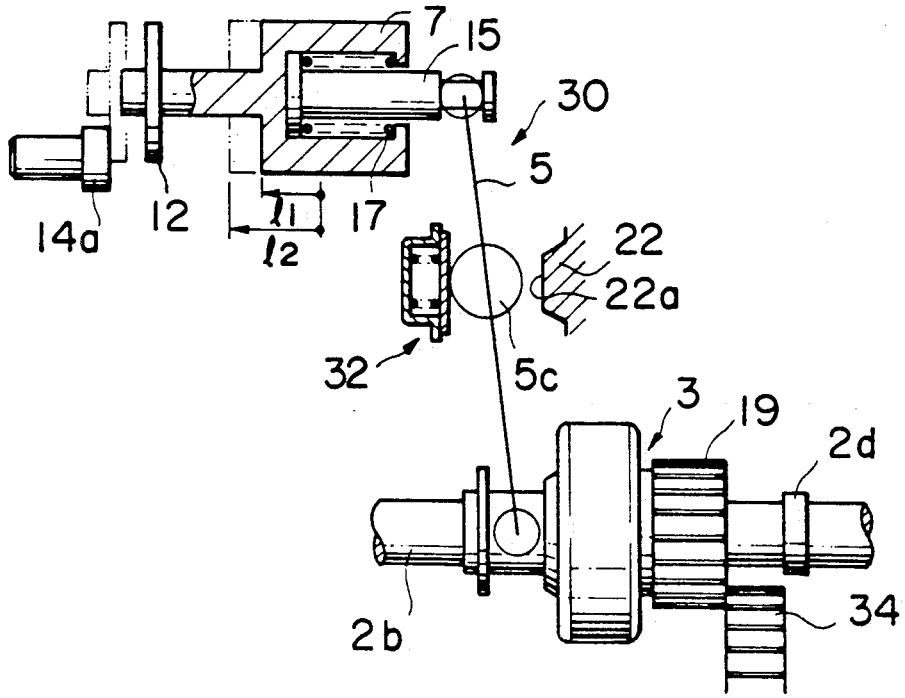
Figure 4C:
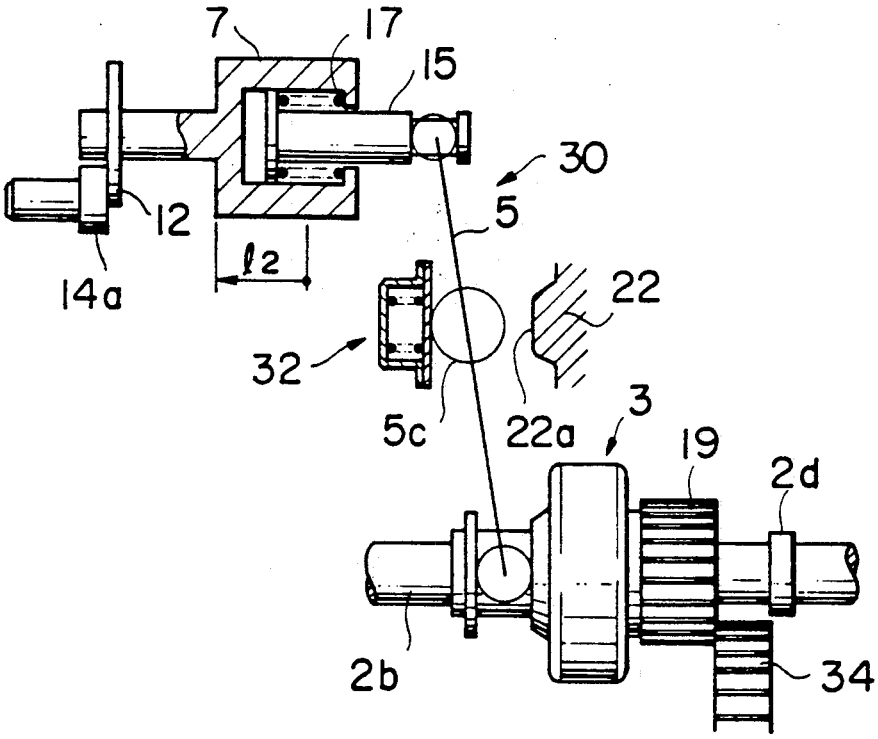

After the stage shown in FIG. 4*b* is reached, further movement of the plunger 7 toward left in the figure is made possible only by the compression of the spring 17; the top end 5*a* of the lever 5 and hence the engager 15 engaging therewith cannot be moved any further toward left in the figure, from the state shown in FIG. 4*b*. Thus, during the time after the plate 32*c* abuts on the support base 32*a* as shown in FIG. 4*b* until the plunger 7 moves to the final (or extreme rear) position as shown in FIG. 4*c*, the movement of the plunger 7 toward the core 8 compresses the spring 17. When the plunger 7 moves to its final position as shown in FIG. 4*c*, the movable contact 12 comes into contact with the stationary contact 14*a*, thereby making the energization current supplied to the motor 2. The urging force S2 developed by the spring 1m during the above period of time is as shown in FIG. 5, wherein $l_2$ represents the distance travelled by the plunger 7 from the time the spring 32*b* begins to be compressed until the plunger 7 reaches its final position. This urging force S2 acts, via the lever 5, on the pinion assembly 3 to shift it into engagement with the ring gear 34 of the engine over the initial short distance $(l_2-l_1)$, when the pinion 19 is finally brought into meshing engagement as explained below referring to FIG. 4*d*; thus, the spring modulus of the spring 17 is selected at a high enough value which ensures that the engagement of the pinion 19 with the ring gear 34 is effected without failure.

When the movable contact 12 and the stationary contact 14*a* is brought into contact as shown in FIG. 4*c* to make the energization current supplied to the electric motor 2, the torque thus generated by the motor 2 is transmitted to the pinion 19 via the one-way clutch 18, thereby rotating the pinion 19 by a small angle to the meshing position with respect to the ring gear 34 of the engine. Thus, thanks to the urging force S2 of the spring 17 transmitted via the lever 5 as the pivot support 5*c* as its fulcrum, the pinion assembly 3 is shifted forward into engagement with the ring gear 34; after the spring 17 thus extends to its full length within the bore of the plunger 7 to force the pinion 19 into meshing engagement with the ring gear 34, the spring 32*b* of the resilient support 32 extends to shift the pinion assembly 3 further forward until the front side of the pinion 19 abuts against the stop ring 2*d* secured on the output shaft 2*b* of the motor 2. The final fully engaged position of the pinion assembly 3 is shown in FIG. 4*d*.

As has been made clear in the above description by reference to FIGS. 4*a* through 4*d* and 5, the initial weaker attractive force acting on the plunger 7 from the core 8 over the inital length $1_1$ is opposed only by the urgining force S1 of the spring 32*b*, the stronger urging force S2 of the spring 17 being dormant and not effective over the same length $1_1$; when, on the other hand, the strong urging force S2 of the spring 17 comes into play and acts on the plunger 7, it is overcome by the strong magnetic attactive force acting on the plunger 7 that is now positioned at a small distance from the core 8. This is clearly seen from FIG. 5. Thus, even when the voltage supplied to the coil 10 of the electromagnetic switch device 4 is substantially reduced below the rated level to reduce the attractive magnetic force from the level of the normal curve P to that of the curve P', the magnitude of the attractive magnetic force acting on the plunger 7 is substantially greater than the urging force S1 or S2 at respective gap lengths g. Hence, thanks to the provision of the resilient support means 32, the movement of the plunger 7 over the whole length is ensured by a small-sized coil 10, which fact results in the distinctive feature of the starter of FIG. 3 mentioned in (d) above.

Figure 4D:
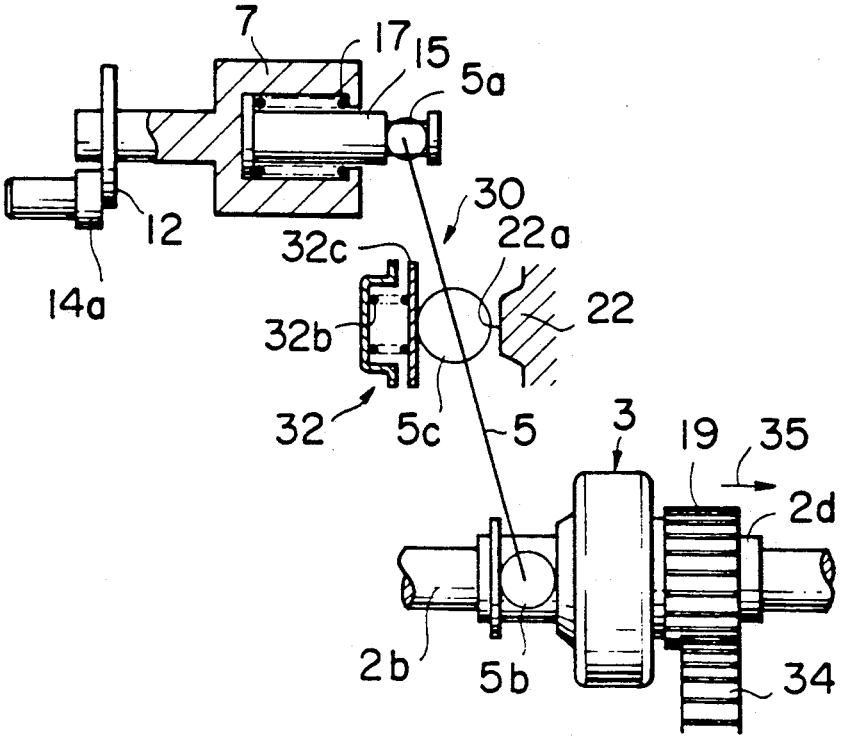

By the way, the dimensional relationship of the pinion shifting mechanism of the starter of FIG. 3 is selected in this manner: even when the pinion 19 is at the full engagement position as shown in FIG. 4*d*, there still remains a small gap between the front side of the pivot support 5*c* and the opposing support surface 22*a* of the front bracket 22. This gap serves two puroses, as explained below:

First, when the pinion 19 is in engagement with the ring gear 34 as shown in FIG. 4*d*, the urging force of the spring 32*b* keeps on urging the the pivot support 5*c* toward the opposing surface 22*a*; thus, the pinion assembly 3 is continuously urged, via the lower end 5*b* of the lever 5, in the forward direction 35. This is effective in preventing the backward movement of the pinion assembly 3 during engagement with the ring gear 34. Namely, during the time when the engine is being started, a backward force may momentarily be generated at the one-way clutch 18 by the pulsating rotation of the engine. The urging force of the spring 32*b* prevents the back and forth rattling (or vibrating) movement of the pinion assembly 3 which may be caused by this pulsating rotation of the engine.

Second, the provision of the above gap is effective for reducing the clearance at the upper and lower engagement of the lever to a negligble magnitude, as pointed out in (b) above. First, let us explain why a substantial clearance is necessary at the upper and lower engagements of the lever 5 in the starter of FIG. 1.

As described in the introductory portion by reference to FIG. 1, the movable contact 12 is mounted on a support sleeve 12*a* slidable on the plunger rod 7*a*, the sleeve 12*a* being urged by the spring 24 toward the stop ring 7*c* secured on the rod 7*a*. Thus, the movable contact 12 yields and is translated by a small axial length relative to the rod 7*a* upon contact with the stationary contact 14*a*, so that contact failure due, for example, to abrasion may not occur. If a clearance corresponding to the axial yielding length of the movable contact 12 is not provided at the upper and lower engagements of the lever 5, the following problem is caused: Let us assume that the coil 10 is de-energized after the engine is started by the motor 2, and that the plunger 7 is returned (i.e., moved toward right in the figure) by the return spring 11 by a small axial distance that is shorter than the axial yielding length of the movable contact 12; then, the pinion assembly 3 is shifted backward (toward left in the figure) by an axial length corresponding to the forward movement of the plunger 7, via the lever 5 which is assumed to be in tight engagement at the upper and lower ends thereof; during this time the contacts 12 and 14*a* remains in contact. Thus, the motor 2 keeps on rotating and driving the pinion assembly 3 via the helical splines 2*c* on the output shaft 2*b*; due to the transmission of torque via the helical splines 2*c*, the pinion assembly 3 receives an axial, as well as a rotational, force from the splines 2*c*, such that the pinion assembly 3 is driven in the forward direction. This forward movement of the pinion assembly 3 resulting from the torque of the motor 2 is transmitted via the lever 5 to the plunger 7, thereby forcing the plunger 7 backward against the force of the return spring 11. Consequently, the contacts 12 and 14*a* is forced to remain in contact, so as to continue to supply the energization current to the motor 2 even after the power supply to the electromagnetic switch 4 is stopped.

In contrast to the above, in the case of the starter of FIG. 3 according to this invention, the clearance at the upper and lower engagement ends of the lever 5 can be reduced to a neglgible minimuum value which is necessary to allow the operation of the lever 5; the reason for this is as follows:

As has been assumed above by reference to FIG. 4*d*, there remains a small gap between the pivot support 5*c* of the lever 5 and the opposing support surface 22*a* even when the pinion assembly is in the full engagement with the ring gear 34. The width of this gap is selected at a value large enough such that the small initial return movement of the plunger 7 over the axial yielding length of the movable contact 12 is absorbed by the movement of the pivot support 5*c* of the lever 5 over the above mentioned small gap, and does not cause any movement of the lower end 5*b* of the lever 5. Consequently, the pinion assembly 3 remains at the full engagement position shown in FIG. 4*d* during this time. Only after the plunger 7 is returned by the return spring 11 for an axial length equal to or greater than the yielding axial length of the movable contact 12 to complete the separation of the contacts 12 and 14*b*, the front side of the pivot support 5*c* of the lever 5 abuts on the opposing support surface 22*a*. Thus, when the lever 5 begins to rotate on the fixed pivot support 5*c* as its fulcrum and the pinion assembly 3 thus begins to be shifted backward by the return movement of the plunger 7 via the lever 5, the electric motor 2 is already de-energized. As a result, there cannot arise the problem that the supply of the energization current to the motor 2 is not stopped even when the power supply to the electromagnetic switch device 4 is stopped. Hence, the clearance at the upper and lower engagement ends of the lever 5 of the starter of FIG. 3 can be reduced to a minimum without any adverse effects.

This reduction of the clearance at the upper and lower engagement of the lever 5 makes possible to reduce the initial gap length between the plunger 7 and the core 8 as pointed out in (c) above. The reduction of the inital gap length between the plunger 7 and the core 8 makes it possible to reduce the size of the excitation coil 10, as explained in the introductory portion of this specification and pointed out in (d) above. Thus, the reduction of the clearance at the engagement of the lever 5 results not only in the reduction of the axial length of the switch device 4, but also in the reduction of the overall size and cost thereof.

Figure 6:
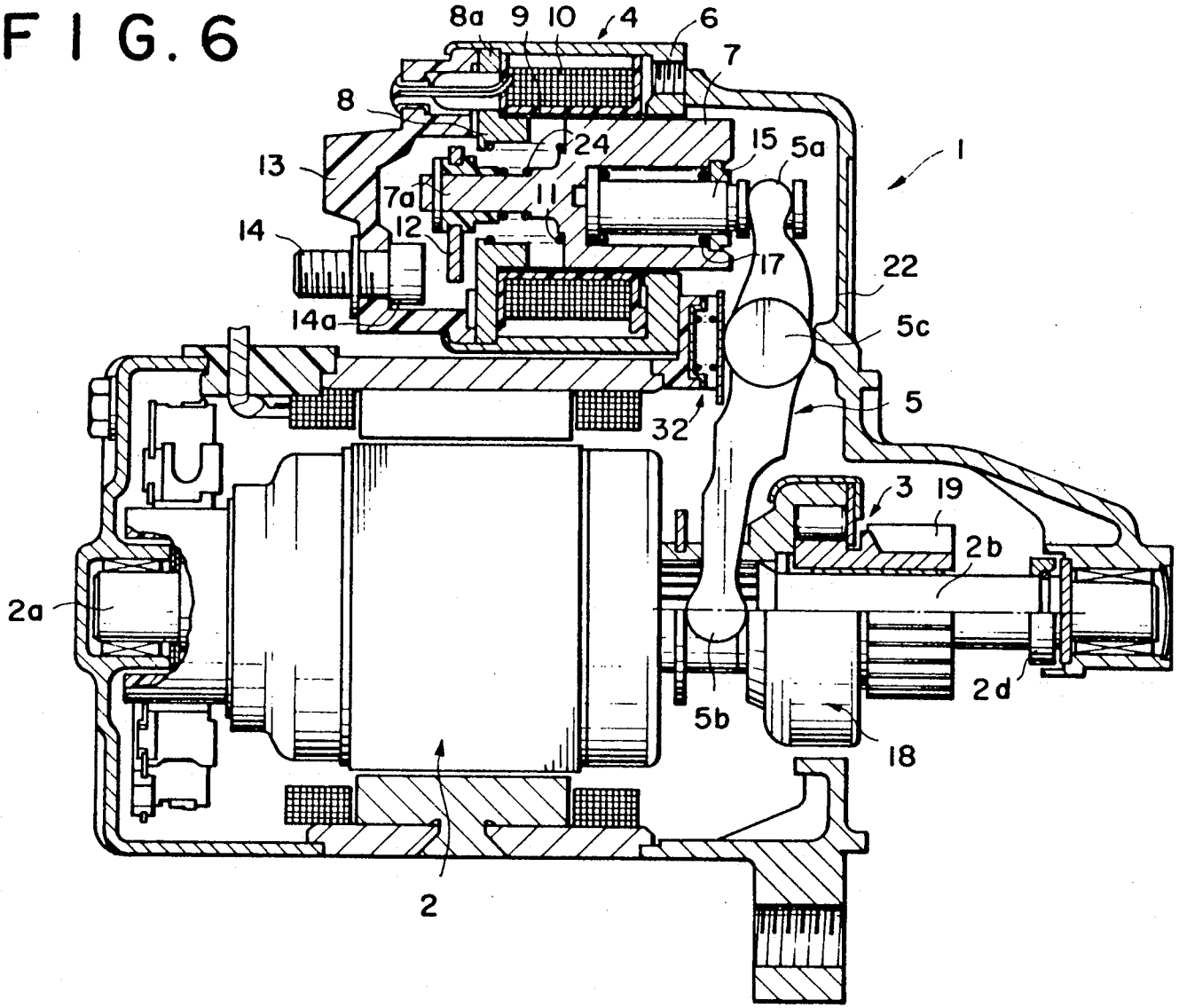
FIGS. 6, 7 and 8 are views similar to that of FIG. 1, but showing starters according to second, third and fourth embodiments of this invention, respectively.
Figure 7:
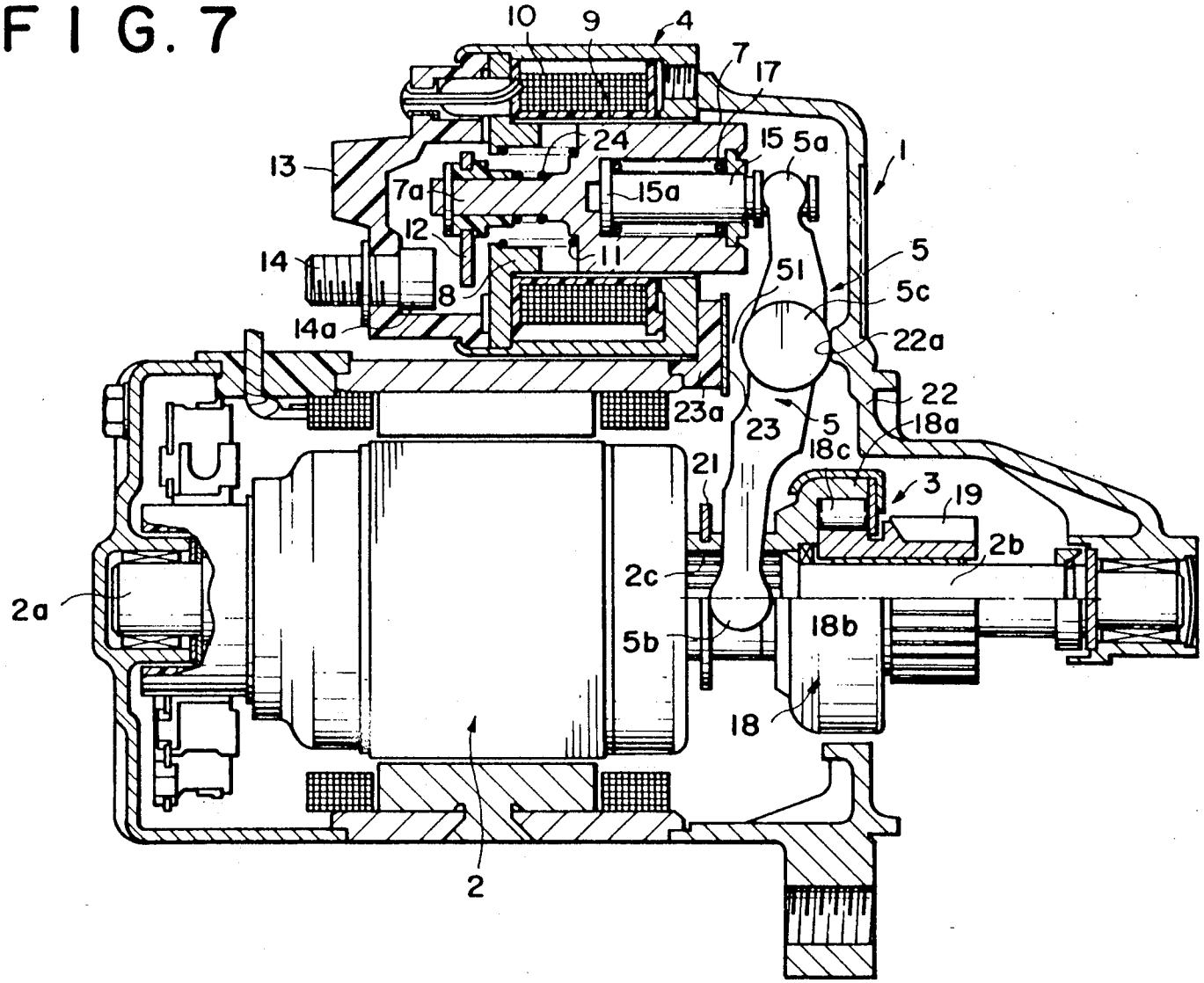
Figure 8:
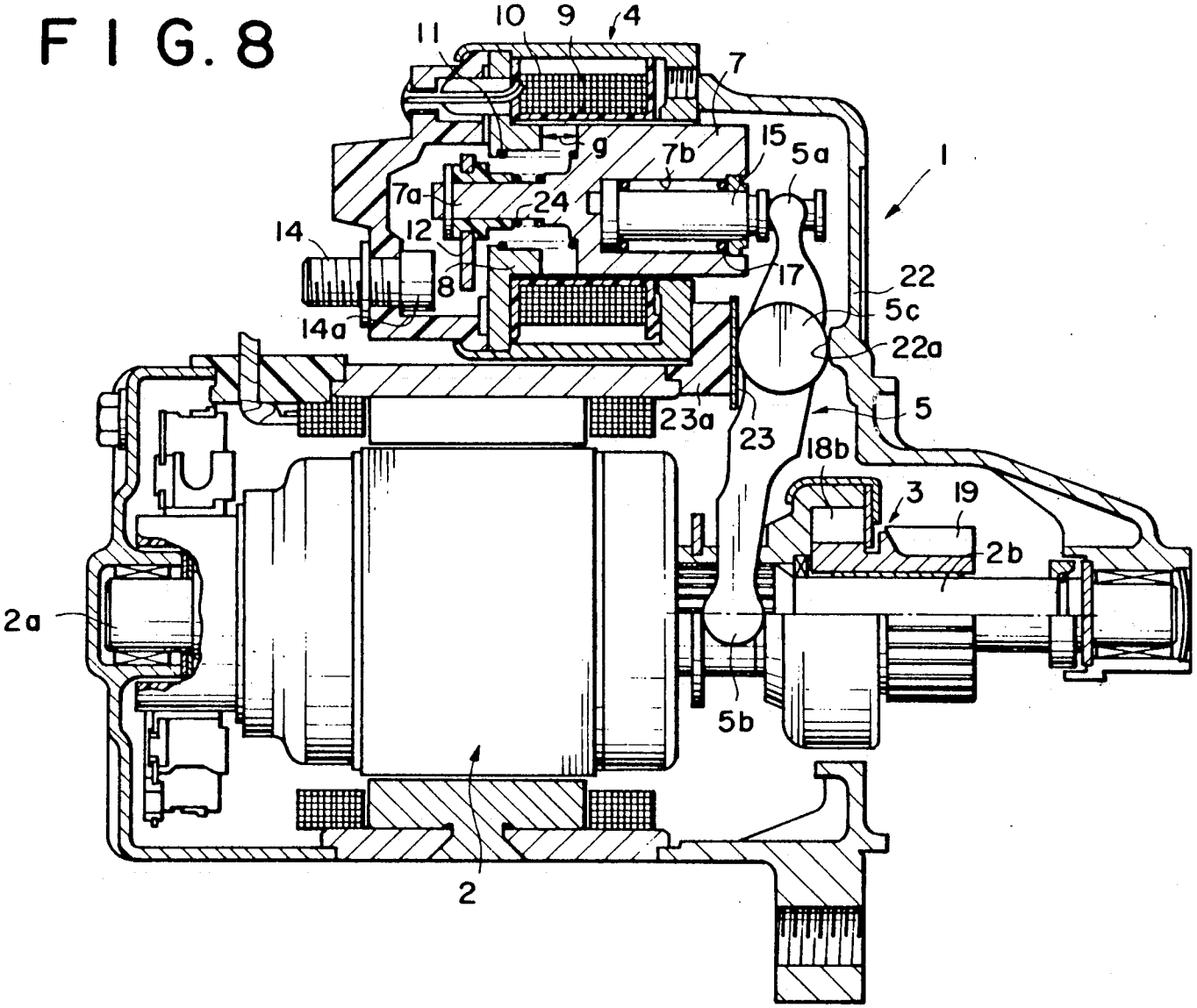

Let us now describe a second through fourth embodiment of this invention referring to FIGS. 6 through 8.

FIG. 6 shows a starter device according to a second embodiment of this invention. The starter of FIG. 6 is identical with that shown in and described by reference to FIG. 3 above (wherein corresponding parts are designated by like reference numerals), except for the following difference:

The central axial line of the engager member 15 is displaced, with respect to the central axial line of the plunger 7 within which it is slidably disposed, toward the axis of the output shaft 2*b* of the motor 2: thus, the length of the upper arm of the lever 5 from the pivot support 5*c* to the upper end 5*a* is made shorter compared with that of the lever 5 of the starter 1 of FIG. 3. As a result, the leverage of the lever 5, i.e., the ratio of the lower arm length from the lower end 5*b* to the pivot support 5*c* to the upper arm length from the pivot support 5*c* to the upper end 5*a* of the lever 5, is made greater, and hence the inital gap length g between the plunger 7 and the stationary core 8 (i.e., the total axial length of movement of the plunger 7) is rendered still shorter compared with the case of FIG. 3; thus, the size and cost of the coil 10 and hence those of the whole electromagnetic switch device 4 can be further reduced. Otherwise, the structure and operation of the starter of FIG. 6 is similar to those of the starter of FIG. 3.

FIG. 7 shows a starter according to a third embodiment of this invention, which is similar to the starter of FIG. 3, except for the following difference:

Instead of the resilient support means 32 of the starter of FIG. 3, a gap 51 of a predetermiened width corresponding to the yielding length of the spring 32*b* of the resilient means 32*a* of the starter of FIG. 3 is formed between the rear side of the pivot support 5*c* of the lever 5 and the opposing surface of a metal plate 23 mounted on a support base 23*a* corresponding to those of the starter of FIG. 1 designated by the same reference numerals. During the time when the plunger 7 is moved from its inital front position over the inital length $\mathbf{1}_1$ shown in FIGS. 4*a*, 4*b*, and 5, the pivot support 5*c* of the lever 5 is translated toward left in the figure over the gap 51, to finally abut at its rear side on the surface of the metal plate 23. Thus, the operation of the pinion shifting mechamism of the starter of FIG. 7 is the same as that of the pinion shifting mechanism of the starter of FIG. 3 described by reference to FIGS. 4*a* through 4*d* and 5 above, except that the urging force S1 of the spring 32*b* of the resilient support 32 is not developed and does not act on the pivot support 5*c* of the lever 5 over the inital length $\mathbf{1}_1$. It should be noted, however, that since no force is developed which urges the pinion assembly 3 forward when the pinion 19 is in full engagement with the ring gear as shown in FIG. 4*d*, the back and forth vibrating movement of the pinion assembly 3 may be caused by the pulsating rotation of the engine during the starting period thereof.

FIG. 8 shows a starter according to a fourth embodiment of this invention which is similar to the starter of FIG. 1 described in the introductory portion of this specification, except for the following difference:

The central axis of the engager member 15 is displaced, with respect to the central axis of the plunger 7 within which it is slidably disposed, toward the axis of the output shaft 2*b* of the motor 2: thus, the length of the arm of the lever 5 from the pivot support 5*c* to the upper end 5*a* is made shorter compared with that of the lever 5 of the starter 1 of FIG. 1. As a result, the leverage of the lever 5, i.e., the ratio of the lower arm length from the lower end 5*b* to the pivot support 5*c* to the upper arm length from the pivot support 5*c* to the upper end 5*a* of the lever 5, is made greater, and hence the initial gap length g between the plunger 7 and the stationary core 8 (i.e., the total axial length of movement of the plunger 7) is rendered shorter; thus, the size and cost of the coil 10 and hence those of the whole electromagnetic switch device 4 can be reduced compared with the case of the starter of FIG. 1.

Although this invention has been applied in the above embodiments to the starters for automotive internal combustion engines, it goes without saying that this invention is applicable to any mechanism in which a driving pinion, slidably mounted on an output shaft of a motor, is shifted via a lever by means of an electromagnetic switch, to be engaged with and disengaged from a driven gear.

While description has been made of the particular embodiments of this invention, it will be understood that many modifications may be made without departing from the spirit thereof. The appended claims are contemplated to cover any such modifications as fall within the true sprit and scope of this invention.

What is claimed is:

1. An engine starter for driving a driven gear coupled to an internal combustion engine, comprising:

an electric motor having an output shaft;

a pinion assembly axially slidably mounted on said output shaft of the electric motor to be driven and rotated by the electric motor, said pinion assembly including a pinion adapted to be brought into meshing engagement with the driven gear of the internal combustion engine by a movement of the pinion assembly toward a first axial direction directed away from said electric motor;

an electromagnetic switch device disposed at a side of said electric motor and having a cylindrical plunger driven and slidable between a first and a second position in an axial direction parallel to an axial direction of said output shaft of the electric motor;

an engager member mounted to said plunger of the electromagnetic switch so as to be slidable along the axial direction of the plunger;

first urging spring means (17) for urging said engager member with respect to said plunger in an axial direction opposite to said first axial direction;

a shift lever having one end engaged with an end of said engager member and the other end engaged with said pinion assembly, said shift lever having at a middle of its length a pivot support on which the shift lever can be turned;

support surface means (22*a*) for limiting a movement of said pivot support of the shift lever directed toward said first axial direction; and resilient support means (32) including second urging spring means (32*b*) for urging said pivot support of the shift lever in said first axial direction toward said support surface means, wherein said resilient support means allows, by a yielding of said second urging spring means, a movement of said pivot support of the shift lever in a direction away from said support means over a predetermined length, wherein when said plunger is driven from the first to the second position in a second axial direction opposite to said first axial direction, to shift said pinion assembly via the shift lever toward said first axial direction, said second urging spring means (32*b*) of the resilient support means yields first, before any yielding of said first urging spring means (17) occurs, to allow a movement of the pivot support of the shift lever in said second axial direction, said first urging spring means beginning to yield after said pivot support of the shift lever has been moved away from said support surface means by said predetermined length.

2. An engine starter as claimed in claim 1, wherein:

said electromagnetic switch device comprises a stationary contact and a movable contact for making and breaking energization current supplied to said electric motor, said movable contact being mounted on an extension of said plunger to be brought into contact with said stationary contact by a movement of the plunger to said second position, the movable contact being slidable over a predetermined axial yielding length upon contact with the stationary contact; and after the plunger is driven from the first to the second position in said second axial direction and thereby the pinion is shifted via the shift lever toward said first axial direction into a full engagement with the driven gear of the engine, first by means of an urging force of said first urging spring means, and then by an additional length by means of an urging force of said second urging spring means, even then, a gap of predetermined length corresponding to said axial yielding length of the movable contact is left between the support surface means and an confronting side of the pivot support of the shift lever.

3. An engine starter as claimed in claims 1 or 2, wherein said plunger has an axially extending cylindrical bore and said engager member has a form of a cylinder and axially slidably disposed within said bore of the plunger.

4. An engine starter as claimed in claim 3, wherein a central axis of said engager member is displaced, with respect to a central axis of said plunger, toward the output shaft of said electric motor.

5. An engine starter for driving a driven gear coupled to an internal combustion engine, comprising:

an electric motor having an output shaft;

a pinion assembly axially slidably mounted on said output shaft of the electric motor to be driven and rotated by the electric motor, said pinion assembly including a pinion adapted to be brought into meshing engagement with the driven gear of the internal combustion engine by a movement of the pinion assembly toward a first axial direction directed away from said electric motor;

an electromagnetic switch device disposed at a side of said electric motor and having a plunger driven and slidable between a first and a second position in an axial direction parallel to an axial direction of said output shaft of the electric motor, a movement of said plunger from the first to the second direction being in a second axial direction opposite to said first axial direction;

an engager member mounted to said plunger of the electromagnetic switch so as to be slidable along the axial direction of the plunger;

urging spring means for urging said engager member with respect to said plunger in said second axial direction;

a shift lever having one end engaged with an end of said engager member and the other end engaged with said pinion assembly, said shift lever having at a middle of its length a pivot support on which the shift lever can be turned;

first support surface means for limiting a movement of said pivot support of the shift lever directed toward said first axial direction; and second support surface means for limiting a movement of said pivot support of the shift lever directed toward said second axial direction, wherein a gap of predetermined length is formed between said second support surface means and a confronting side of said pivot support of the shift lever when said plunger is at said first position.

6. An engine starter as claimed in claim 5, wherein said plunger has a cylindrical bore and said engager member has a form of a cylinder and axially slidably disposed within said bore of the plunger.

7. An engine starter for driving a driven gear coupled to an internal combustion engine, comprising:

an electric motor having an output shaft;

a pinion assembly axially slidably mounted on said output shaft of the electric motor to be driven and rotated by the electric motor, said pinion assembly including a pinion adapted to be brought into meshing engagement with the driven gear of the internal combustion engine by a movement of the pinion assembly toward a first axial direction directed away from said electric motor;

an electromagnetic switch device disposed at a side of said electric motor and having a cylindrical plunger driven and slidable between a first and a second position in an axial direction parallel to an axial direction of said output shaft of the electric motor, said plunger having an axially extending cylindrical bore formed therein;

a cylindrical engager member disposed in said bore of the plunger of the electromagnetic switch so as to be slidable along the axial direction of the plunger, a central axis of said engager member being displaced, with respect to a central axis of said plunger, toward said output shaft of the electric motor;

urging spring means, disposed around said engager within said bore of the plunger, for urging said engager member with respect to said plunger in a direction opposite to said first axial direction;

a shift lever having one end engaged with an end of said engager member and the other end engaged with said pinion assembly, said shift lever having at a middle of its length a pivot support on which the shift lever can be turned; and support means for supporting said pivot support of the shift lever.

* * * * *